US005315351A

United States Patent [19]

Matsushiro et al.

[11] Patent Number: 5,315,351

[45] Date of Patent: May 24, 1994

[54] IMAGE FORMING APPARATUS

[75] Inventors: Moriyoshi Matsushiro, Nagoya; Naoki Toyoshi; Tsugihito Yoshiyama, both of Toyohashi, all of Japan

[73] Assignee: Minolta Camera Kabushiki Kaisha, Osaka, Japan

[21] Appl. No.: 865,035

[22] Filed: Apr. 7, 1992

[30] Foreign Application Priority Data

Apr. 8, 1991 [JP] Japan ..... 03-075411
Apr. 8, 1991 [JP] Japan ..... 03-075412

[51] Int. Cl.[5] ..... G03G 21/00
[52] U.S. Cl. ..... 355/246; 355/208
[58] Field of Search ..... 355/245, 246, 208, 261, 355/228; 118/665, 664, 688-691

[56] References Cited

U.S. PATENT DOCUMENTS 4,572,654 11/1982 Murai et al. ..... 355/246 X
4,962,407 10/1990 Ueda ..... 355/208
4,982,232 1/1991 Naito ..... 355/208

FOREIGN PATENT DOCUMENTS 60-133475 7/1985 Japan .

*Primary Examiner*—A. T. Grimley
*Assistant Examiner*—Shuk Y. Lee
*Attorney, Agent, or Firm*—Burns, Doane, Swecker & Mathis

[57] ABSTRACT

An image forming apparatus in which a light amount of an irradiation lamp for exposure or voltage value of a developing bias applied to a developing electrode is adjusted based upon density value of test toner images formed on the surface of the photosensitive member for preventing the occurrence of toner fogging.

26 Claims, 11 Drawing Sheets

IMAGE FORMING APPARATUS

BACKGROUND OF THE INVENTION

1. Field of the Invention

The present invention relates to image forming apparatus of electrophotographic type copying apparatus, and more specifically relates to an image forming apparatus having an automatic control device for image density.

2. Description of the Related Art

In recent years, organic photosensitive members have been used mainly as the electrostatic latent image bearing members in electrophotographic type copying apparatus. Certain types of organic photosensitive members have disadvantages inasmuch as the sensitivity characteristics of the photosensitive members relative to light deteriorate, or the residual electric potential on the surface of the photosensitive members may rise as the number of times it is used increases, so as to cause an elevation in the electric potential in the background area of the image. When the electric potential becomes elevated in the background region of the image, so-called toner fogging frequently occurs which results in a decrease in contrast between the image area and the image background area.

SUMMARY OF THE INVENTION

A main object of the invention is to provide an image forming apparatus capable of normally forming superior images.

A further object of the present invention is to provide an image forming apparatus having a photosensitive member which does not produce an elevation of the electric potential of the image background area with prolonged use.

A still further object of the present invention is to provide an image forming apparatus capable of correcting changes in the sensitivity characteristics of the photosensitive member or elevations in residual potential on the surface of the photosensitive member produced as the number of times it is used increases.

The aforesaid objects of the invention are achieved by providing an image forming apparatus as described below.

An image forming apparatus comprising: discharging means for discharging the electric charge on the surface of a photosensitive member upon test image formation;

developing means for forming a toner image on the surface of the photosensitive member with a toner, said developing means including a developing electrode to which at least two kinds of biases having different voltages and the same polarity as a toner charge polarity are applied upon test image formation, so that at least two test toner images having different densities are formed on the surface of the photosensitive member discharged by said discharging means;

detecting means for detecting the density of each the test toner images; and control means for controlling voltage value of a developing bias to be applied to the developing electrode during normal image formation based on detection value of the test toner images.

The aforesaid objects of the present invention are further achieved by providing an image forming apparatus as described below.

An image forming apparatus comprising:

charging means for charging the surface of a photosensitive member at a predetermined potential;

exposure means for exposing the charged surface of the photosensitive member with at least two different light amounts to form at least two test electrostatic latent images;

developing unit for developing said test electrostatic latent images with a developer accommodated therein to form test toner images;

detecting means for detecting the density of each the test toner images;

calculating means for calculating sensitivity characteristics value of the photosensitive member based on detection values of the test toner images;

storing means for storing a reference light amount of exposure and reference sensitivity characteristics value of the photosensitive member; and control means for controlling the light amount of exposure based on the reference light amount and the sensitivity characteristics value of the photosensitive member respectively stored in said storing means, and the sensitivity characteristics value of the photosensitive member calculated by said calculating means.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 3 is a block diagram of the control circuit;

FIG. 4 is a flow chart showing the image stabilization process;

FIG. 5 is a graph showing the surface potential of the photosensitive member relative to the amount of exposure light;

FIG. 6 is a graph showing the relationship between the voltage value for the reverse developing bias and the amount of adhered toner;

FIG. 7 is a flow chart showing the main routine of the central processing unit (CPU);

FIG. 8 is a flow chart showing the image stabilization process subroutine of the main routine of the CPU;

FIG. 9 is a block diagram of the control circuit;

FIG. 10 is a time chart showing the image stabilization process;

FIG. 11 is a graph showing the amount of adhered toner and the surface electric potential of the photosensitive member relative to the amount of exposure light;

FIG. 12 is a flow chart showing the image stabilization process subroutine of the main routine of the CPU which is identical to that shown in FIG. 7.

DETAILED DESCRIPTION OF THE PREFERRED EMBODIMENTS

The first embodiment of the present invention is described hereinafter.

Construction and Operation of the Copying Apparatus

Figure 1:
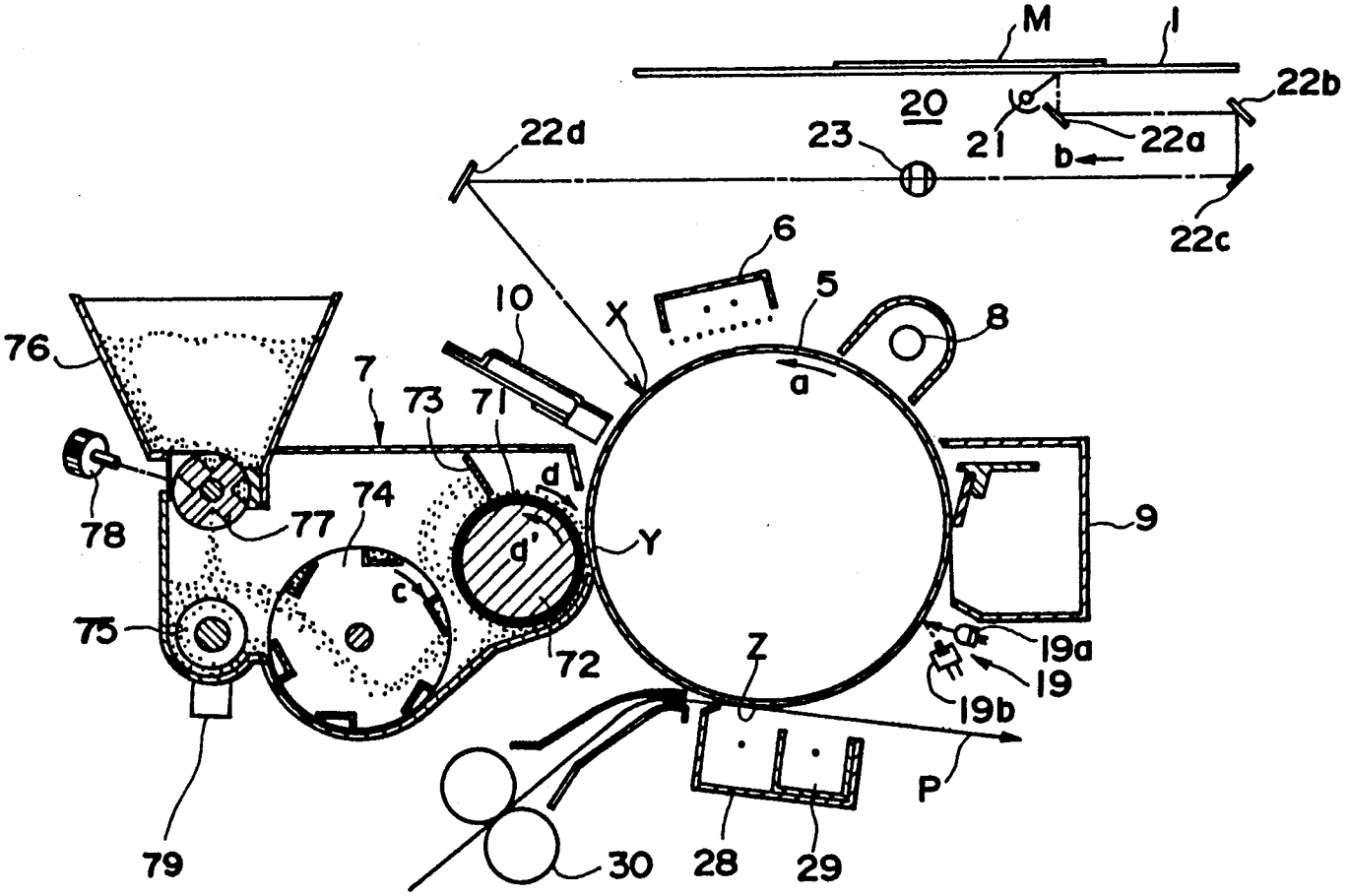
FIG. 1 is an illustration briefly showing the construction of the electrophotographic copying apparatus of the present invention.

As shown in FIG. 1, the photosensitive drum 5 is rotatably driven at constant a circumferential speed v in the direction indicated by arrow a. The image of the original document M disposed on the glass document platen 1 is exposed at the exposure area X via the optical system 20 so as to form an electrostatic latent image corresponding to the original image on the surface of the photosensitive drum 5.

The optical system 20 comprises exposure lamp 21, mirrors 22*a* through 22*d*, and projecting lens 23. During image exposure, the exposure lamp 21 and mirror 22*a* are moved in the direction of arrow b at a speed v/m (where m is the copy magnification), and the mirrors 22*b* and 22*c* are movable at a speed v/2m.

Arranged around the periphery of the photosensitive drum 5 are a charger 6 for uniformly charging the surface of the photosensitive drum 5 with a predetermined electric potential, image interval eraser 10 for removing the image interval electric load outside the latent image forming area, developing device 7 for developing the electrostatic latent image formed via the optical system 20 by adhering toner thereon, transfer charger 28 for transferring the aforesaid toner image onto a copy sheet fed from the registration roller 30, separation charger 29 for separating the copy sheet from the photosensitive drum 5, cleaner 9 for removing residual toner that remains on the surface of the photosensitive drum 5, and main eraser 8 for removing the residual electric load from the surface of the photosensitive drum 5.

Construction and Operation of the Developing Apparatus

The developing device 7 uses a developing material comprising a mixture of a magnetic carrier and an insulated toner for so-called standard developing wherein the toner is adhered to the charged area of the latent image as it passes the developing portion Y via a well known magnetic brush method.

Within the developing tank 70 are provided a developing sleeve 71 installed in a magnet roller 72, brush-height regulating member 73, bucket roller 74, and screw roller 75. The developing material is attracted to the exterior surface of the developing sleeve 71 by the magnetic force of the magnet roller 72 based on the rotation of the bucket roller 74 in the arrow c direction, and is thereafter transported to the developing portion Y based on either the rotation of the developing sleeve 71 in the arrow d direction or the rotation of the magnet roller 72 in the arrow d, direction. The developing sleeve 71 functions as a developing electrode such that during a normal copy process a developing bias of a predetermined voltage and a polarity which is opposite the charge polarity of the toner is applied to said developing sleeve 71 so as to prevent the toner from adhering to the image background area.

On the other hand, a toner supplying roller 77, which is rotatably driven by a supply motor 78, is provided at the base of the toner tank 76 arranged at the top of the toner tank 70. The toner accommodated in the toner tank 76 is supplied to the top of the screw roller 75 via the rotation of the supply roller 77, and is then mixed with the developing material already present via the rotation of the roller 75 before being transported to the bucket roller 74. The toner is triboelectrically charged through the aforesaid mixing with the magnetic carrier so as to attain a predetermined amount of electric charge. The toner density within the developing material is detected by a magnetic sensor 79 provided within the developing tank 70, and the supply motor 78 is controlled so as to maintain a normally constant toner density.

Photosensitive Member Residual Electric Potential Rise

Figure 5:
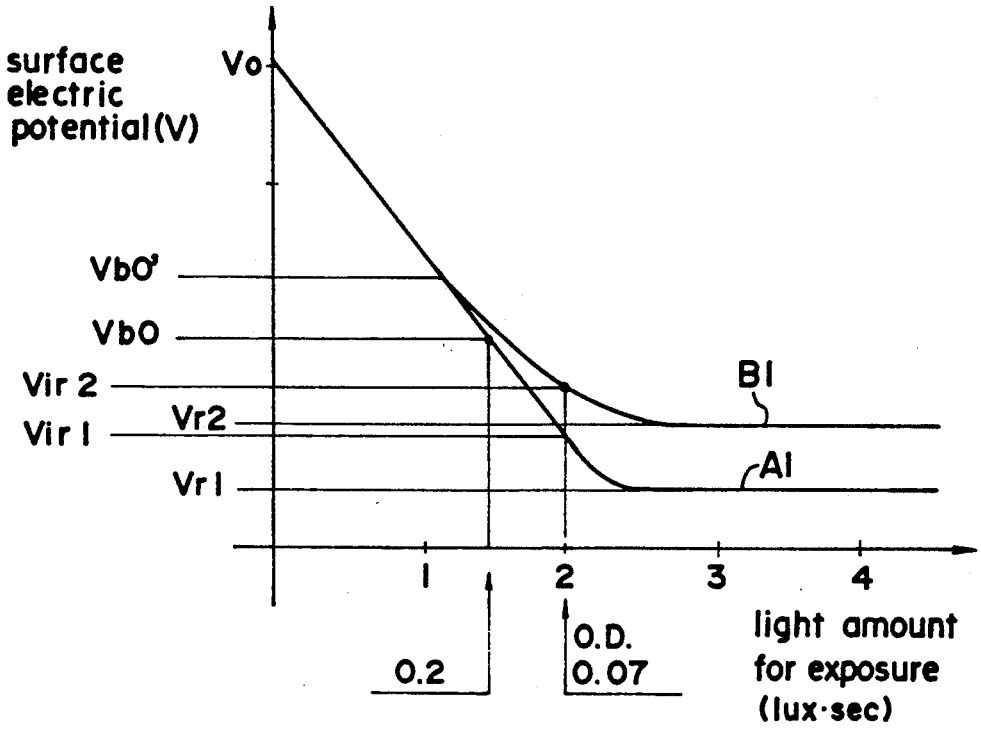

The copying apparatus of the first embodiment uses an organic photosensitive member, one characteristic of which is that the electric potential rises with use. FIG. 5 shows the surface potential of the photosensitive member relative to the amount of exposure light; in the drawing, curve A1 indicates the initial sensitivity characteristics, and curve B1 indicates the sensitivity characteristics at about the half-way point in the service life of the photosensitive member. As can be readily understood from FIG. 5, the initial residual surface potential is Vr1, and the residual potential corresponding to the area of original document image density of 0.07 (corresponding to an exposure light of 2.01 lux.sec) is Vir1. The developing bias voltage applied to the developing sleeve 71 during developing is Vb0. The developing bias voltage Vb0 corresponds to the residual potential of the area where the original document image density is 0.2 (corresponding to an exposure light of 1.4 lux.sec) such that this area of electric potential is not developed. Thus, when the photosensitive member is initially used, there is a sufficient gap between the developing bias voltage Vb0 and the residual voltage Vir1 so that toner fogging does not occur in the image background area.

On the other hand, after the photosensitive member has been used beyond about the half-way point in its service life, the residual electric potential rises to Vr2, and the residual potential corresponding to an original document image density of 0.07 rises to Vir2. If, in this case, the developing bias is maintained at a voltage Vb0, the gap between the bias voltage Vb0 and the residual electric potential Vir2 becomes smaller so that toner fogging occurs in the image background area, and ultimately toner adheres in the area corresponding to an original document image density of 0.2. Therefore, it is necessary to elevate the developing bias voltage to Vb0, after the aforesaid use so as to prevent toner fogging in the image background area.

The constant correlative relationship between the residual electric potential Vr2 of the photosensitive member and the developing bias voltage Vb0' required to prevent toner fogging is shown in FIG. 5. Accordingly, it is necessary to precisely detect the residual electric potential Vr2 of the photosensitive member when controlling the voltage value of the developing bias.

Residual Electric Potential Detection and Developing Bias Voltage Control

In order to accomplish image stabilization in the present embodiment, the electric load present on surface of the photosensitive drum 5, which has been uniformly charged by the charger 6, is removed by the image interval eraser 10 so as to form two electrostatic latent images having residual electric potentials of Vr2 on the surface of the photosensitive drum 5. Then, the reverse developing bias voltages Vb1 and Vb2 (opposite polarity to that used the during normal copying process; same polarity as the toner charge polarity) are respectively applied to the developing sleeve 71, and the toner is forcibly adhered to the test latent images of the residual potential Vr2 areas so as to form two test toner images. The test toner image densities are then optically detected by reflecting-type photosensor 19.

Figure 6:
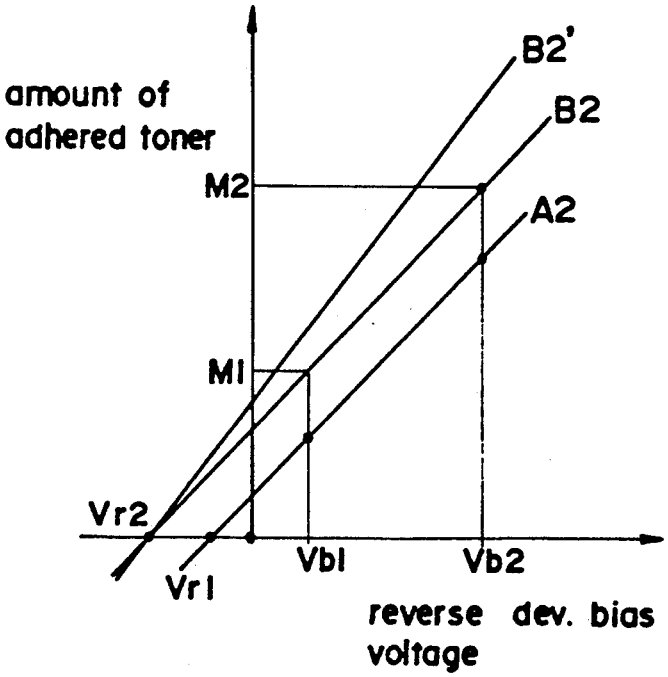

FIG. 6 shows the relationship between the reverse developing bias voltage value applied to the developing sleeve 71 and the amount of adhered toner (test toner image density). In the drawing, curve A2 indicates the initial sensitivity characteristics, and curve B2 indicates the sensitivity characteristics at about the half-way point in the service life of the photosensitive member. The slope of curve B2 is determined by the amounts of adhered toner M1 and M2 corresponding to the reverse developing bias voltages Vb1 and Vb2, and is conducted by the then current residual electric potential Vr2. The curve B2, indicates the amount of adhered toner when the toner density and amount of toner charge have been elevated and the photosensitive member characteristics are indicated by the curve B2. Thus, the residual electric potential Vr2 can be determined by detecting the densities of at least two types of test toner image densities whenever the developing characteristics change.

The method of calculating the residual electric potential is described hereinafter. The function expressing the aforesaid characteristics is shown in Equation 1.

$$y=ax+b \tag{1}$$

After some use, the Equation 2 is derived from Equation 1.

$$a=(M2-M1)/(Vb2-Vb1) \tag{2}$$

On the other hand, when the reverse developing bias voltage Vb2 has been impressed, the amount of adhered toner M2 is expressed by Equation 3.

$$M2=a\cdot Vb2+b \tag{3}$$

The value b in Equation 1 can be expressed via Equation 4.

$$b=M2-a\cdot Vb2 \tag{4}$$

When y=0, the residual electric potential Vr2 is obtained. Accordingly, by substituting the values of the aforementioned Equations 2 and 4 in Equation 5, $$0=a\cdot Vr2+b \tag{5}$$

the residual electric potential Vr2 can be expressed by Equation 6.

$$Vr2=-b/a=(M2\cdot Vb1-M1\cdot Vb2)/(M2-M1) \tag{6}$$

That is, the residual electric potential Vr2 can be determined via the aforesaid Equation 6 by detecting the densities (amounts of adhered toner) of the test toner images formed under the predetermined reverse developing bias voltages Vb1 and Vb2. Then, the developing bias voltage Vb0' is calculated via the following Equation 7, said developing bias voltage Vb0, being applied during the copying process while the residual electric potential is in the state expressing the characteristics of Vr2.

$$Vb0'=k(Vr2-Vr1)+Vb0 \tag{7}$$

where k is a constant.

When the value for Vb0' calculated in the aforesaid manner is used as the developing bias voltage applied to the developing sleeve 71 in the subsequent copying process, excellent copy images are produced which have no toner fogging in the image background area.

Examples of the Image Stabilization Process

Examples of controls for test toner image formation, image density detection of said test toner images, and developing bias voltages are described hereinafter.

Figure 2:
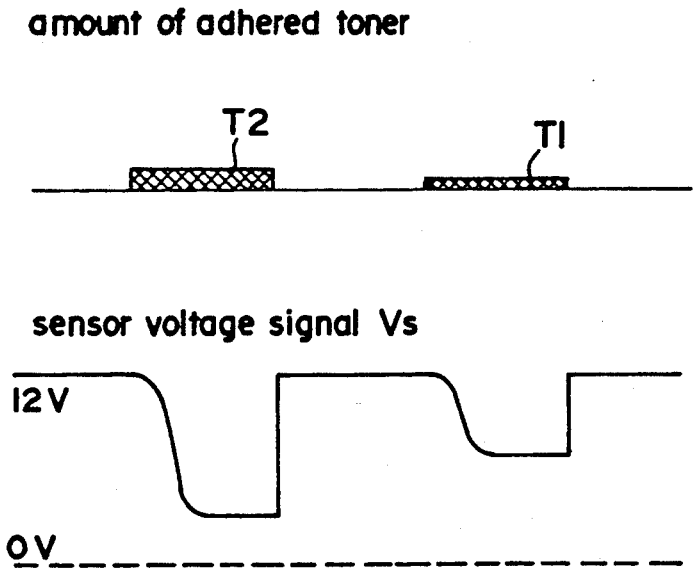
FIG. 2 is a chart showing the relationship between the amount of adhered toner of the formed test toner images and the output voltages of the sensors detecting the amount of adhered toner in the first and second embodiments of the present invention.

As shown in FIG. 2, when the reverse developing bias voltage Vb2 is applied to the developing sleeve 71, a relatively dense test toner image T2 is formed, whereas when the reverse developing bias voltage Vb1 is applied, a relatively thin test toner image T1 is formed. The aforesaid densities are detected via reflecting-type photosensor 19. The photosensor 19 comprises a photoemitter element 19*a* and a photoreceptor element 19*b*, and is provided opposite the surface of the photosensitive drum 5 between the transfer portion Z and the cleaning device 9 at a position corresponding to the test toner images T1 and T2. Accordingly, the densities of the test toner images T1 and T2 are detectable by the aforesaid photosensor 19. If the test toner image density is dense, the amount of reflected light decreases and the output voltage Vs of the photoemitter element 19*b* is reduced, whereas if the test toner image density is thin, the amount of reflected light increases and the output voltage Vs of the photoemitter element 19*b* is therefore increased.

Figure 3:
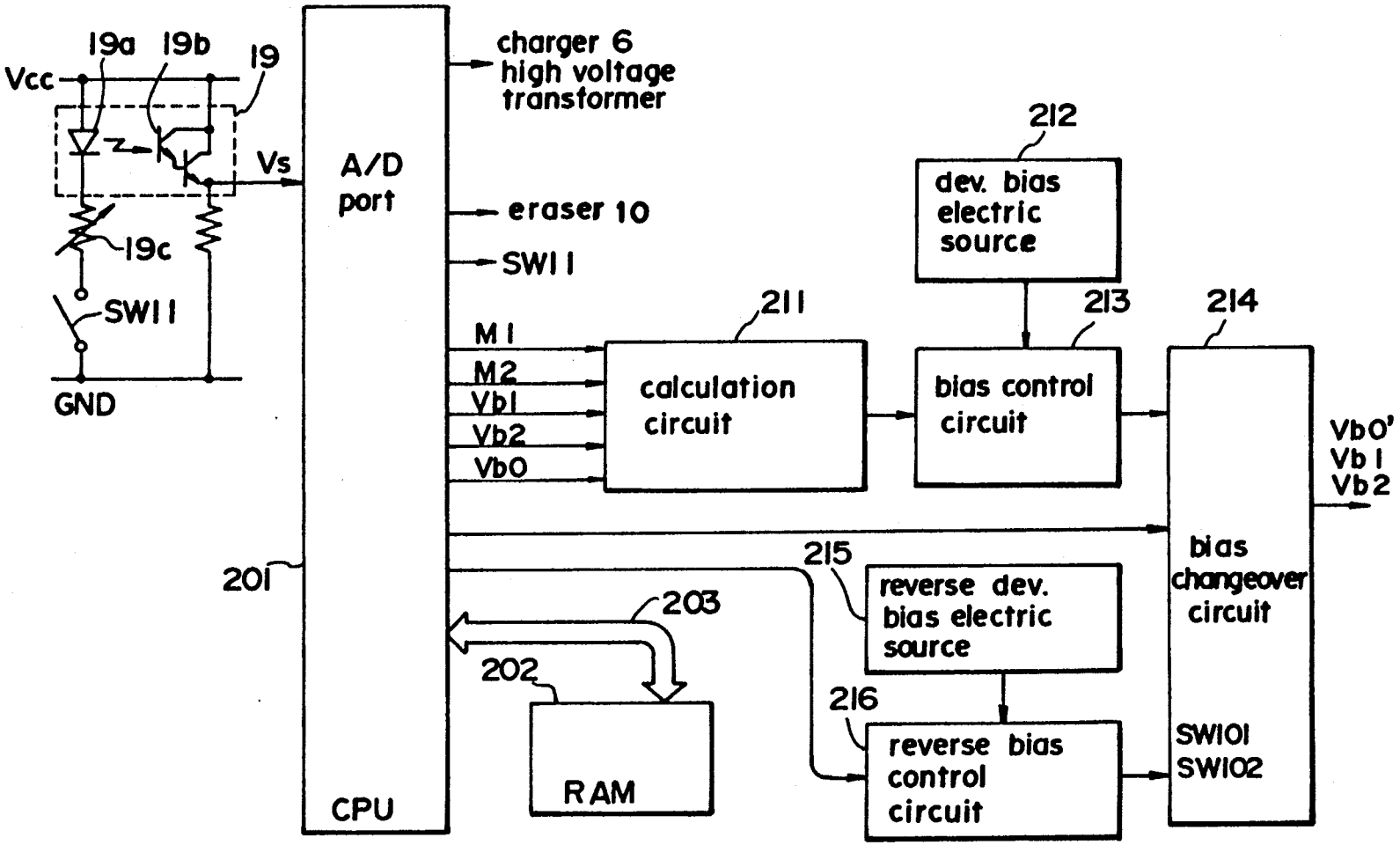
FIGS. 3 through 8 are illustrations showing a first embodiment.

As shown in FIG. 3, the photoemitter 19*a* is grounded via the switch SW11 and the variable resistor 19*c*; the output voltage Vs of the photoreceptor element 19*b* is input to the analog-to-digital (A/D) port of the microcomputer 201 (hereinafter referred to as the "CPU"). The input sensor output voltage Vs is converted to digital signals by the A/D converter, transmitted through the data bus 203 and stored in random access memory (RAM) 202, which has battery backup, so as to be suitably fetched therefrom during data processing.

The calculation circuit 211 for calculating the developing bias voltage, bias switching circuit 214, and reverse developing bias control circuit 216 provided with a reverse developing bias power source 215 are connected to the output ports of the CPU 201. The bias control circuit 213 is provided with a developing bias power source 212, and controls the standard developing bias voltage applied to the developing sleeve 71 to the calculated value Vb0'. The reverse bias control circuit 216 controls the reverse developing bias voltages applied to the developing sleeve 71 during the image stabilization process to form test toner images such that said values are regulated to the values Vb1 and Vb2. The switches SW101 and SW102 are included in the bias switching circuit 214. The switch SW101 switches between positive and negative voltages; when the switch SW101 is OFF, the voltage is negative (during the copy process), whereas when said switch SW101 is ON, the voltage is positive (during the image stabilization process). When the switch SW101 is turned ON, the voltage Vb2 is output and the test toner image T2 is formed.

When the switch SW102 is turned ON, the voltage Vb1 is output and the test toner image T1 is formed.

Figure 4:
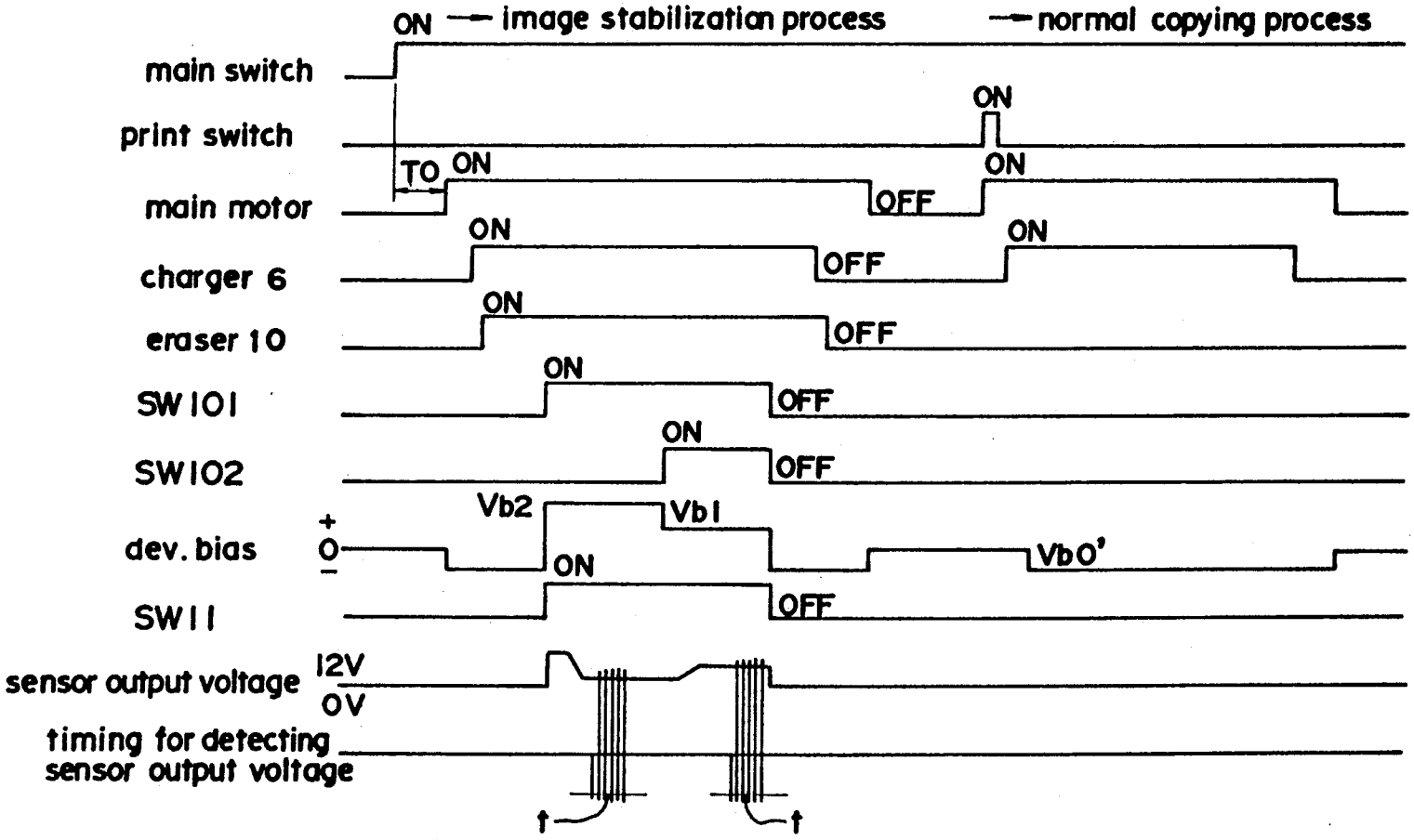

The image stabilization process is described hereinafter with reference to the flow chart of FIG. 4.

The image stabilization process is executed when the main switch is turned ON and power is supplied to the copying apparatus. The image stabilization process is further executed each time a predetermined time interval has elapsed.

When the main switch is turned ON, the fixing device (not shown in the drawing) is warmed up for a predetermined period T0 only. Thereafter, the main motor is turned ON to begin rotating the photosensitive drum 5, the charger 6 and the image interval eraser lo are turned ON, and the surface of the photosensitive drum 5 is charged once, then discharged. When the discharged portion of the photosensitive drum 5 arrives at the developing portion Y, the switch SW101 is turned ON, and the reverse developing bias voltage Vb2 is applied to the developing sleeve 71 to form the test toner image T2. Thereafter, the switch SW102 is turned ON, and the reverse developing bias voltage Vb1 is applied to the developing sleeve 71 to form the test toner image T1.

The switch SW11 which operates the photosensor 19 is turned ON immediately before the test toner images T2 and T1 pass the detection point of the photosensor 19 so as to measure the amount of reflected light. When toner is not adhered to the surface of the photosensitive drum 5, the output voltage Vs of the photoreceptor element 19*b* is 12 V in the present embodiment. When the test toner images T2 and T1 pass the aforesaid detection point, the output voltage Vs of the photoreceptor element 19*b* is detected at the completion of each of five cycles of a time interval t, and the detected output values Vs are averaged to determine the amount of adhered toner M2 and M1. The residual electric potential Vr2 is calculated via Equation 6 based on the aforesaid detection values, and Equation 7 is used to calculate the developing bias voltage Vb0' used during the normal copying process.

Control Sequence

The control sequence for the CPU 201 during the previously mentioned image stabilization process is described hereinafter with reference to the flow charts of FIGS. 7 and 8.

Figure 7:
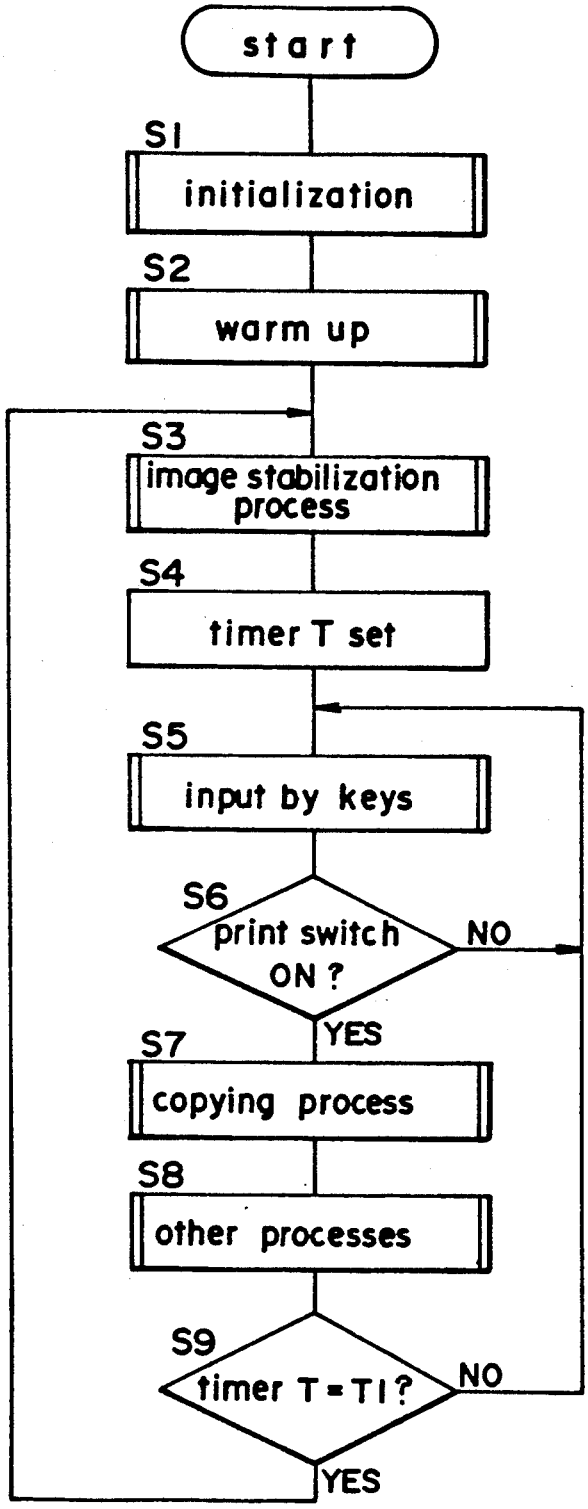

FIG. 7 shows the main routine of the CPU 201.

When the power supply is turned ON and the CPU 201 is reset, the program is started and the initialization process is executed in step S1 to clear the RAM 202, initialize each register, and set each device in the initialization mode. Then, in step S2, the warmup process is executed, and in step S3 the image stabilization process is executed. Details of the image stabilization process are described with reference to FIG. 8.

In step S4, the timer T is set, and in step S5 the input signals from the various keys on the control panel (not illustrated) of the copying apparatus are processed. In step S6, a check is made to determine whether or not the print switch has been turned ON, and if the reply to the query is NO, the routine returns to step S5. If the reply to the aforesaid query in step S6 is YES, the copying operation process is executed in step S7, and other processes such as the fixing device temperature control and the like are executed in step S8. Then, in step S9, a check is made to determine whether or not the aforementioned timer T has reached a predetermined time T1, and if the reply to the query is NO, the routine returns to step S5. If the reply to the query in step S9 is YES, the routine returns to step S3 and the image stabilization process is executed.

Figure 8:
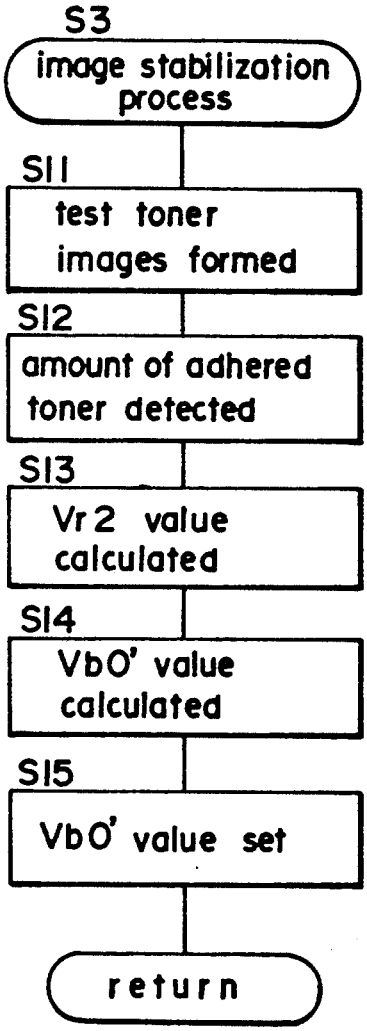

FIG. 8 shows a flow chart of the image stabilization process subroutine executed in step S3.

First, in step S11, the test toner images T1 and T2 are formed by the previously described process, and in step S12 the toner densities, i.e., the amounts of adhered toner M1 and M2, are detected via the photosensor 19. Then, in step S13, the residual electric potential Vr2 is calculated using the aforementioned Equation 6, and in step S14 the developing bias voltage Vb0' corresponding to the residual potential Vr2 is calculated using the aforementioned Equation 7. In step S15, the value of the aforesaid calculated developing bias voltage Vb0' is set for use in subsequent copying processes.

A second embodiment of the present invention is described hereinafter.

The construction and operation of the second embodiment of the copying apparatus are substantially similar to that of the first embodiment with the exception that the amount of light emitted by the exposure lamp 21 is regulated by controlling the voltage applied to said lamp. Therefore, details of the similar aspects of the first and second embodiments are omitted from the present description.

Furthermore, the construction and operation of the developing device of the of the second embodiment are identical to that of the first embodiment and are therefore omitted from the present description.

Figure 11:
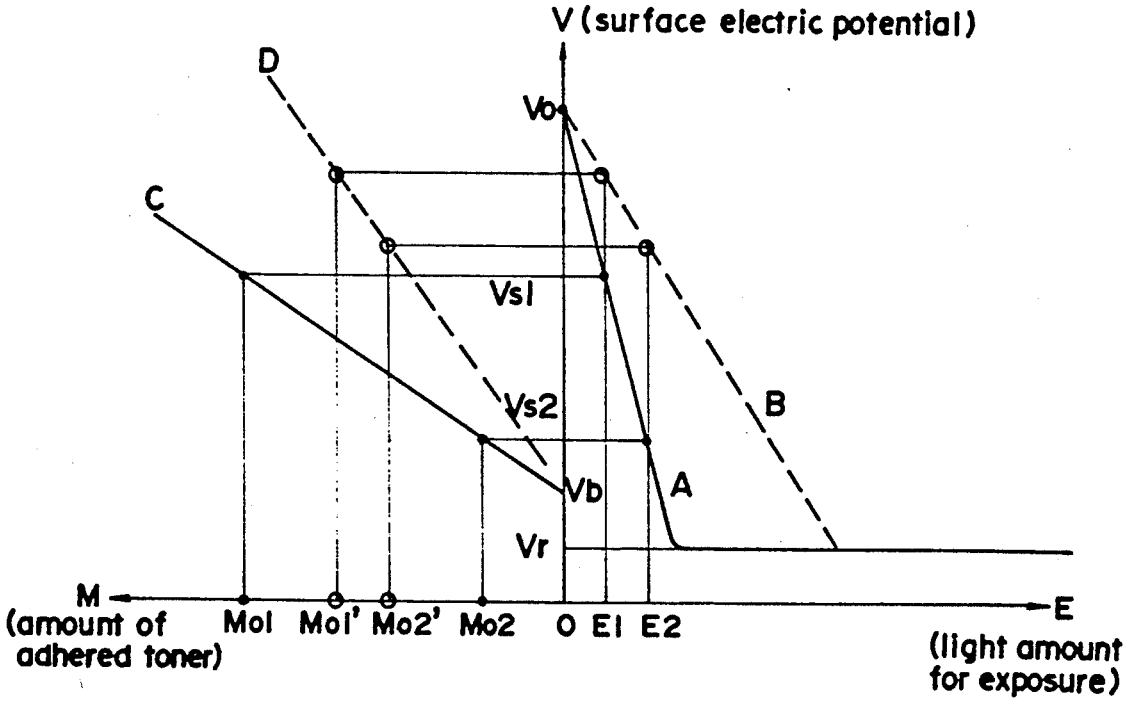

Deterioration of Photosensitive Member Sensitivity Characteristics, Detection of Same, and Exposure Light Control The copying apparatus of the second embodiment uses an organic photosensitive member, one characteristic of which is that sensitivity characteristics deteriorate with use. FIG. 11 shows the photosensitive member surface potential V and the amount of adhered toner M relative to the amount of exposure light E. The solid line A indicates the initial sensitivity characteristics, and the dashed line B indicates the sensitivity characteristics at about the half-way point in the service life of the photosensitive member. The solid line C expresses the developing characteristics for the amount of adhered toner M relative to the surface electric potential V when the sensitivity characteristics conform to line A. The dashed line D expresses the developing characteristics when the sensitivity characteristics conform to line B. As can be readily understood from FIG. 11, although the residual potential Vr remains constant through the initial period and even after use, the sensitivity characteristics change with use from the solid line A to the dashed line B, and the developing characteristics change at the same time from the solid line C to the dashed line D.

That is, when a relatively large amount of light E2 (near the image background area) is used for exposure, the surface electric potential of the photosensitive member is Vs2, and the amount of toner adhered to the Vs2 potential portion is Mo2. Furthermore, when a relatively small amount of light E1 (corresponding to the image area) is used for exposure, the surface electric potential of the photosensitive member is Vs1, and the amount of toner adhered to the Vs1 potential portion is Mo1. In contrast, after some use, the amount of toner adhered under an exposure light E2 increases to Mo2', and the amount of toner adhered under an exposure light E1 decreases to M01'. In other words, toner fogging is produced in the image background area, thereby reducing the contrast of the copy image. Accordingly, after some use, the amount of light emitted by the exposure lamp 21 must be increased so as to eliminate the aforesaid disadvantage.

There is a constant correlation between the sensitivity characteristics of the photosensitive member and the developing characteristics, as shown in FIG. 11. Accordingly, in the present embodiment, the surface of the photosensitive member is charged with a predetermined electric potential Vo by the charger 6, and exposed by light E1 and E2 via the optical system 20 so as to form two test electrostatic latent images having dissimilar electric potentials. Then, a predetermined developing bias voltage Vb is applied to the developing sleeve 71, and toner is adhered to the aforesaid test latent images so as to form two test toner images. The densities of the aforesaid test toner images are then optically detected by the reflecting type photosensor 19 (refer to FIG. 1).

The relationship of the surface electric potential V of the photosensitive member to the amount of exposure light E and the charge potential Vo provided via the charger 6 is expressed in Equation 1 below.

$$V=-\alpha E+Vo \quad (1)$$

where $\alpha$ is the initial sensitivity of the photosensitive member.

The relationship of the amount of adhered toner M to the post-exposure surface potential Vs and the developing bias voltage Vb is expressed in Equation 2 below.

$$M=(Vs-Vb)\gamma \quad (2)$$

On the other hand, the relationship between the surface potentials Vs1 and Vs2 relative to the exposure light E1 and E2, respectively, is shown in Equations 3 and 4 below.

$$Vs1=-\alpha E1+Vo \quad (3)$$

$$Vs2=-\alpha E2+Vo \quad (4)$$

The relationship between the amounts of adhered toner M1 and M2 relative to the surface potentials Vs1 and Vs2 are expressed by the Equations 5 and 6 below.

$$M01=(Vs1-Vb)\gamma \quad (5)$$

$$Mo2=(Vs2-Vb)\gamma \quad (6)$$

When determining the sensitivity characteristics $\alpha$ from the Equations 3 and 4 and determining the developing characteristics $\gamma$ from the Equations 5 and 6, the following Equations 7 and may be derived.

$$\alpha=(Vo-Vb)(Mo1-Mo2)/(Mo1\cdot E2-Mo2\cdot E1) \quad (7)$$

$$\gamma=(Mo1\cdot E2-Mo2\cdot E1)/(Vo-Vb)(E2-E1) \quad (8)$$

Thus, if the amounts of adhered toner Mo1 and Mo2 are detected, the initial sensitivity $\alpha$ and the developing characteristics $\gamma$ can be calculated using Equations 7 and 8. At the same time, if the amounts adhered toner Mo1' and Mo2' are detected, the sensitivity $\alpha'$ and the developing characteristics $\gamma'$ at present can be calculated.

$$\alpha'=(Vo-Vb)(Mo1'-Mo2')/(Mo1'\cdot E2-Mo2'\cdot E1) \quad (7')$$

Therefore, when the sensitivity is in the state expressed by $\alpha'$, the optimum amount of exposure light Eopt' can be determined using Equation 9 where the initial standard amount of exposure light is designated Eopt.

$$Eopt'=\alpha'\cdot Eopt/\alpha \quad (9)$$

A constant value k may be introduced in Equation 9 as needed. The initial standard exposure light Eopt and the sensitivity $\alpha$ of the photosensitive member may be value set for each particular product. The photosensitive member sensitivity characteristics $\alpha$, in particular, must be premeasured since said value will be different for each type of photosensitive member used and each production lot.

The Eopt and $\alpha$ values are either stored in the RAM or the like of the main control portion before the copying apparatus is shipped from the factory, or service personnel installing the copying apparatus run tests wherein the $\alpha$ value is measured for the adjusted standard exposure light Eopt and then both Eopt and $\alpha$ values are stored in the RAM or the like.

The optimum amount of light exposure Eopt' at present is determined from the Eopt and $\alpha$ values premeasured and stored in the RAM or the like and the sensitivity characteristics $\alpha'$ at present.

Furthermore, the value of the photosensitive member sensitivity $\alpha'$ at present is updated. That is, the sensitivity value $\alpha'$ determined in the previous cycle is used as the sensitivity value $\alpha$ of the present cycle so as to determine the sensitivity value $\alpha'$ for the present cycle.

If the optimum amount of exposure light Eopt' calculated via the aforesaid method is used as the amount of exposure light for the exposure lamp 21 in subsequent copying processes, superior copy images are produced which have excellent contrast of the image portion and background portion without toner fogging in the image background area.

Each time the image stabilization process is executed, the following conditions are desirable:

(1) charging potential Vo is stabilized;

(2) post-exposure surface potential Vs is in uniform relationship to the amount of exposure light E;

(3) photosensitive member residual potential Vr is uniform over time;

(4) amount of adhered toner M is in uniform relationship to Vs-Vb. In the present embodiment, condition (1) can be stabilized by using a scorotron charger as the charger 6, conditions (2) and (3) can be fulfilled by the characteristics of the photosensitive member. Condition (4) can be adequately fulfilled by providing suitable functions in a normal copying machine. Although the developing characteristics are affected by changes in the amount of toner charge and toner density, precise photosensitive member sensitivity characteristics can be determined by forming test toner image of at least two types of densities and detecting the densities (amount of adhered toner) of said test toner images.

Examples of Image Stabilization Process

Examples of the controls for test toner image formation, detection of test toner image density, and amount of exposure light are described hereinafter.

As shown in FIG. 2, a relatively thin density test toner image T1 is formed by the relatively small amount of exposure light E1, and a relatively dense test toner image T2 is formed by a relatively large amount of exposure light E2. The densities of these images are detected by the reflecting type photosensor 19. The photosensor 19 comprises a photoemitter element 19*a* and a photoreceptor element 19*b*, and is provided opposite the surface of the photosensitive drum 5 between the transfer portion Z and the cleaning device 9 at a position corresponding to the test toner images T1 and T2. Accordingly, the densities of the test toner images T1 and T2 are detectable by the aforesaid photosensor 19. If the test toner image density is dense, the amount of reflected light decreases and the output voltage Vs of the photoemitter element 19*b* is reduced, whereas if the test toner image density is thin, the amount of reflected light increases and the output voltage Vs of the photoemitter element 19*b* is therefore increased.

Figure 9:
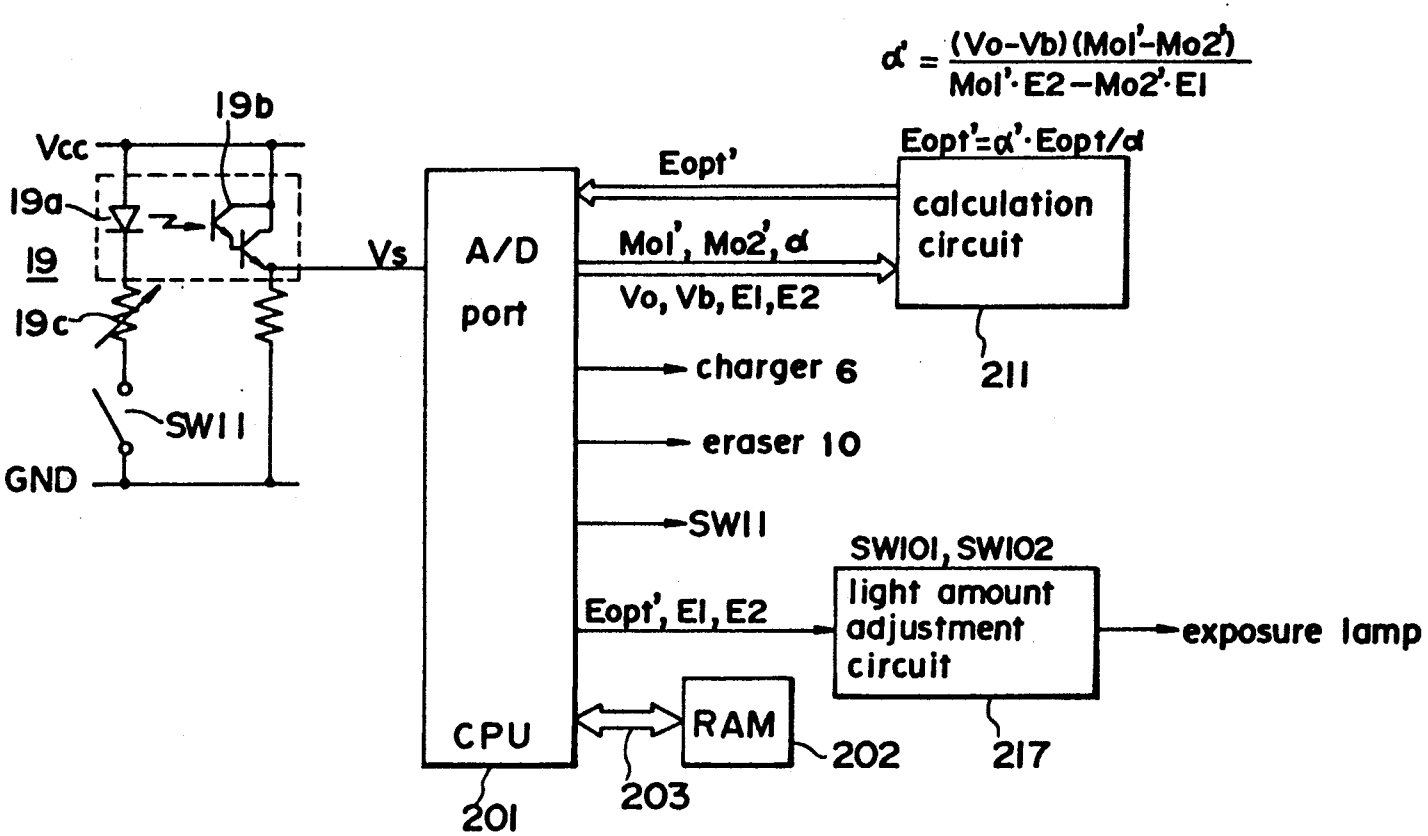
FIGS. 9 through 12 are illustrations showing a second embodiment of the invention.

As shown in FIG. 9, the photoemitter 19*a* is grounded via the switch SW11 and the variable resistor 19*c*; the output voltage Vs of the photoreceptor element 19*b* is input to the A/D port of the CPU 201. The input sensor output voltage Vs is converted to digital signals by the A/D converter, transmitted through the data bus 203 and stored in the RAM 202, which has battery backup, so as to be suitably fetched therefrom during data processing.

The calculation circuit 211 for calculating the amount of exposure light and the dimmer circuit 217 for adjusting the light of the exposure lamp 21 are connected to the output ports of the CPU 201. The dimmer circuit 217 causes the exposure lamp 21 to emit the calculated amount of exposure light Eopt' in the copying process, and the predetermined amounts of light E1 and E2 in the image stabilization process. The switches SW101 and SW102 are included in the dimmer circuit 217. When the switches SW101 and SW102 are turned ON simultaneously, the voltage applied to the exposure lamp 21 is regulated so as to cause the lamp 21 to emit an amount of exposure light E1, and form a test toner image T1. When the switch SW101 is turned ON singly, the voltage applied to the exposure lamp 21 is regulated so as to cause the lamp 21 to emit an amount of exposure light E2, and form a test toner image T2.

Figure 10:
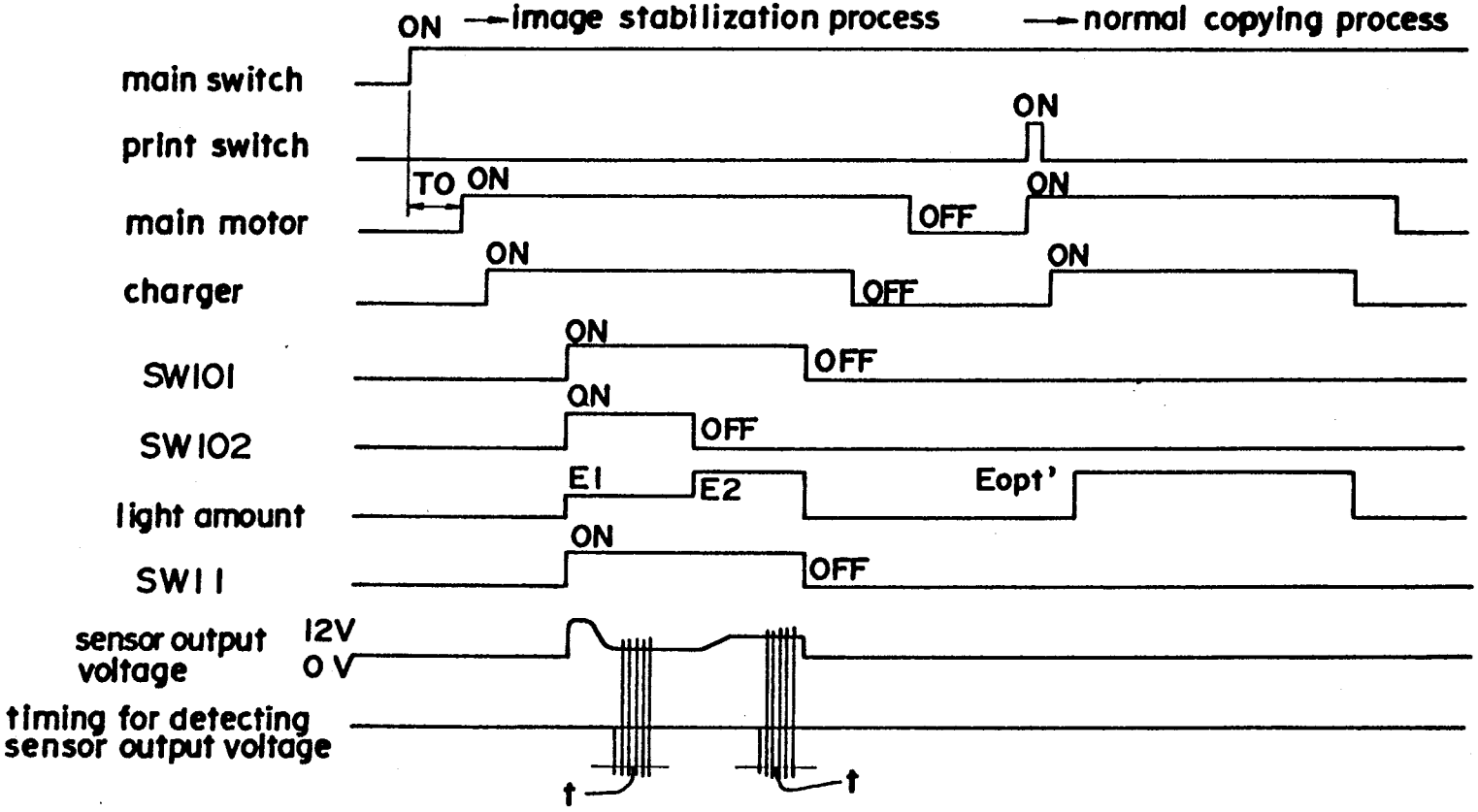

The image stabilization process is described hereinafter with reference to the time chart of FIG. 10.

The image stabilization process is executed when the main switch is turned ON and power is supplied to the copying apparatus. The image stabilization process is further executed each time a predetermined time interval has elapsed.

When the main switch is turned ON, the fixing device (not shown in the drawing) is warmed up for a predetermined period T0 only. Thereafter, the main motor is turned ON to begin rotating the photosensitive drum 5, the charger 6 is turned ON, and the surface of the photosensitive drum 5 is charged with a predetermined electric potential Vo. The switches SW101 and SW102 are turned ON immediately before the charged portion of the photosensitive drum 5 arrives at the exposure portion X, and the charged portion is exposed to an amount of light E1. Thereafter, the switch SW102 is turned OFF, and the charged portion is exposed to an amount of light E2. The test latent image thus formed are developed by a predetermined developing bias voltage Vb at the developing portion Y so as to form the test toner images T1 and T2, respectively.

The switch SW11 which operates the photosensor 19 is turned ON immediately before the test toner images T2 and T1 pass the detection point of the photosensor 19 so as to measure the amount of reflected light. When toner is not adhered to the surface of the photosensitive drum 5, the output voltage Vs of the photoreceptor element 19*b* is 12 V in the present embodiment. When the test toner images T2 and T1 pass the aforesaid detection point, the output voltage Vs of the photoreceptor element 19*b* is detected at the completion of each of five cycles of a time interval t, and the detected output values Vs are averaged to determine the amount of adhered toner Mo1' and Mo2'. The sensitivity characteristics $\alpha$, are calculated using the aforementioned Equation 7 based on these detection values, and the amount of exposure light Eopt' used during the normal copy process is calculated using the Equation 9.

Control Sequence

The image stabilization process is described hereinafter. The main routine of the CPU 201 of the second embodiment is identical to the main routine of the CPU 201 of the first embodiment, and a description of said main routine is therefore omitted herefrom (refer to FIG. 7).

Figure 12:
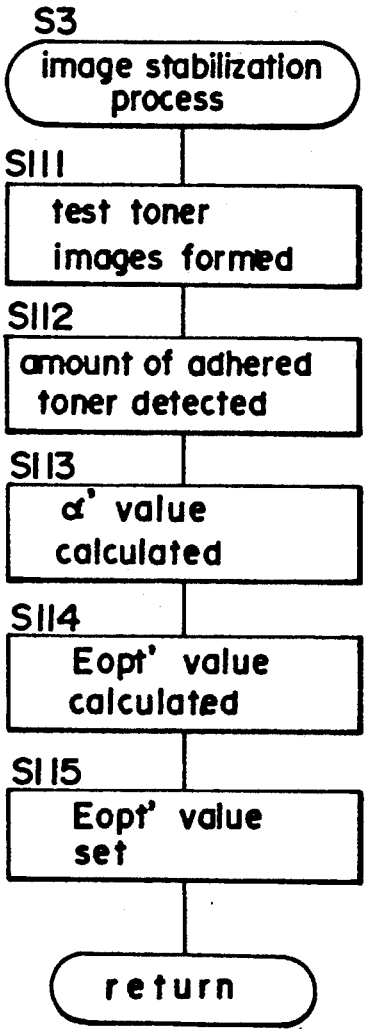

FIG. 12 shows the image stabilization subroutine executed in step S3 of the main routine.

In step S111, the test toner images T1 and T2 are formed via the previously described process, then in step S112, the toner densities, i.e., the amounts of adhered toner M01, and Mo2, are detected via the photosensor 19. Then, in step S113, the sensitivity value $\alpha'$ is calculated using the aforesaid Equation 7', and in step S114, the amount of exposure light Eopt' corresponding to the sensitivity value $\alpha'$ is calculated using the aforesaid Equation 9. In step S115, the value of the aforesaid calculated amount of exposure light Eopt' is set for use in subsequent copying processes.

Other Embodiments

The image forming apparatus of the present invention is not limited to the previously described embodiments, inasmuch as various modifications are possible within the scope of the present invention.

For example, although in the embodiments described above the image stabilization process is executed immediately after power is supplied and each time a predetermined time interval elapses thereafter, said image stabilization process may alternatively be executed for a predetermined number of copy sheets, or a predetermined number of rotations of the photosensitive drum 5.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

I claim:

1. An image forming apparatus comprising:

discharging means for discharging an electric charge on a surface of a photosensitive member upon test image formation;

developing means for forming a toner image on the surface of the photosensitive member with a toner, said developing means includes a developing electrode to which at least two kinds of biases having different voltages and a same polarity as a toner charge polarity are applied upon test image formation, so that at least two test toner images having different densities are formed on the surface of the photosensitive member that has been discharged by said discharging means;

detecting means for detecting the density of each of the test toner images; and control means for controlling the voltage value of a developing bias to be applied to the developing electrode during normal image formation based on the detected values of the test toner images.

2. An image forming apparatus as claimed in claim 1 wherein said discharging means includes light irradiating means.

3. An image forming apparatus as claimed in claim 1 wherein said developing means applies to the developing electrode a developing bias having a polarity opposite the toner charge polarity during the normal image formation.

4. An image forming apparatus as claimed in claim 1 wherein the detected density value is determined plural times by the detecting means.

5. An image forming apparatus as claimed in claim 1 wherein the photosensitive member is formed of organic materials.

6. An image forming apparatus as claimed in claim 1, further comprising:

image forming means for forming an electrostatic latent image on the surface of the photosensitive member, said image forming means including charging means for charging the surface of the photosensitive member and image exposure means for exposing the charged surface of the photosensitive member with an image of an original, wherein the discharging means is positioned between the exposure means and the developing means.

7. An image forming apparatus as claimed in claim 1 wherein the control means is operated when the image forming apparatus is powered on.

8. An image forming apparatus as claimed in claim 7 wherein the control means is operated upon every passage of a predetermined period after the operation of the control means when the image forming apparatus is powered on.

9. An image forming apparatus as claimed in claim 7 wherein the control means is operated every time a predetermined number of sheets have been copied after the operation of the control means when the image forming apparatus is powered on.

10. An image forming apparatus as claimed in claim 7 wherein the control means is operated every time the photosensitive member undergoes a predetermined number of rotations after the operation of the control means when the image forming apparatus is powered on.

11. An image forming apparatus comprising:

charging means for charging a surface of a photosensitive member;

exposure means for exposing the charged surface of the photosensitive member with an image of an original to form an electrostatic latent image on the surface of the photosensitive member;

discharging means for discharging the electric charge on the surface of the photosensitive member when the exposure means is not operated;

developing means having a developing electrode for forming a toner image on the surface of the photosensitive member with a toner;

applying means for applying to the developing electrode a first developing bias having a polarity opposite that of a toner charge polarity when the exposure means is operated and applying to the developing electrode a second developing bias having a polarity which is the same as that of the toner charge polarity when the exposure means is not operated, said second developing bias having a voltage which is applied on at least two levels so that at least two test toner images having different densities are formed on the surface of the photosensitive member;

detecting means for detecting the density of each of the test toner images; and determining means for determining a voltage value of the first developing bias by use of the detected values of the test toner images.

12. An image forming apparatus as claimed in claim 11 wherein the detected density value is determined plural times by the detecting means.

13. An image forming apparatus as claimed in claim 11 wherein the photosensitive member is formed of organic materials.

14. In an image forming apparatus comprising a developing device having a developing electrode for developing, with a toner, an electrostatic latent image formed on a photosensitive member by image forming means, an image stabilization method that is performed when the electrostatic latent image is not formed on the photosensitive member, which comprises the following steps of:

discharging an electric charge on a surface of the photosensitive member;

applying a first developing bias having a polarity which is the same as a toner charge polarity to the developing electrode while changing a bias voltage on a least two levels, so that at least two test toner images having different densities are formed on the surface of the photosensitive member that is discharged by said discharging means;

detecting the density of each of the test toner images; and controlling a voltage value of a second developing bias applied to the developing electrode when the electrostatic latent image is formed during image formation based on the detected values of the test toner images.

15. An image forming apparatus comprising:

charging means for charging a surface of a photosensitive member at a predetermined potential;

exposure means for exposing the charged surface of the photosensitive member with at least two different light amounts to form at least two test electrostatic latent images;

a developing unit for developing said test electrostatic latent images with a developer accommodated therein to form test toner images;

detecting means for detecting a density of each of the test toner images;

calculating means for calculating a sensitivity characteristics value of the photosensitive member based on the detected values of the test toner images;

storing means for storing a reference light amount of exposure and a reference sensitivity characteristics value of the photosensitive member; and control means for controlling the amount of exposure light based on the reference light amount and the sensitivity characteristics value of the photosensitive member respectively stored in said storing means, and the sensitivity characteristics value of the photosensitive member calculated by said calculating means.

16. An image forming apparatus as claimed in claim 15 wherein the reference sensitivity characteristics value is stored in the storing means when the photosensitive member is manufactured.

17. An image forming apparatus as claimed in claim 15 wherein the reference sensitivity characteristics value is calculated based on the detected values of the test toner images when a new photosensitive member is first used.

18. An image forming apparatus as claimed in claim 15 wherein the sensitivity characteristics value is calculated after every passage of a predetermined period, and the sensitivity characteristics value calculated at an end of one predetermined period is used as the reference sensitivity characteristics value with respect to the sensitivity characteristics value calculated at an end of a next predetermined period.

19. An image forming apparatus as claimed in claim 15 wherein the photosensitive member is formed of organic materials.

20. An image forming apparatus as claimed in claim 15 wherein the detected density value is determined plural times by the detecting means.

21. An image forming apparatus as claimed in claim 15 further comprising:

second detecting means for detecting a density of the developer in the developing unit; and second control means for controlling the toner density of the developer based on a value detected by the second detecting means.

22. A method performed in image forming apparatus, which comprises:

charging a surface of a photosensitive member at a predetermined potential;

exposing the charged surface of the photosensitive member with at least two different light amounts of form at least two test electrostatic latent images on the surface of the photosensitive member;

developing said test electrostatic latent images to form test toner images with a toner;

detecting a density of each of the test toner images;

inputting a reference light amount and reference densities of the test toner images in a memory; and determining a suitable amount of exposure light based on the detected values of the test toner images, and the reference light amount and the references densities of the test toner images respectively input in said memory.

23. An image forming apparatus comprising:

charging means for charging a surface of a photosensitive member at a predetermined potential;

original image forming means for forming an original electrostatic latent image by exposing the charged surface of the photosensitive member with an image light corresponding to the original;

test image forming means for forming a test electrostatic latent image by exposing the charged surface of the photosensitive member with a predetermined light amount;

a developing unit for developing said test electrostatic latent image with a developer accommodated therein to form a test toner image;

first detecting means for detecting a density of the test toner image on the surface of the photosensitive member;

second detecting means for detecting a density of the developer in the developing unit;

first control means for controlling the image light amount based on the density of the test toner image; and second control means for controlling the density of the developer based on the value detected by the second detecting means.

24. An image forming apparatus as claimed in claim 23 wherein said original image forming means includes an illumination lamp for irradiating light on the charged surface of the photosensitive member.

25. An image forming apparatus as claimed in claim 23 wherein the developer accommodated in the developing unit is composed of a toner and a carrier, and said second detecting means includes a magnetic sensor for detecting a density of the toner supplied to the developing unit in order to maintain the toner density at a predetermined value.

26. An image forming apparatus as claimed in claim 1, wherein said control means controls the voltage value of the developing bias based on residual electric potentials calculated by the following equation:

$$Vr2 = (M2 \cdot Vb1 - M1 \cdot Vb2)/(M2 - M1)$$
$$(Vb1 < Vb2, M1 < M2)$$

where:

Vr2 is a residual electric potential,

Vb1 and Vb2 are bias voltages having the same polarity as the toner charge polarity and applied to the developing electrode, and M1 and M2 are toner amounts of the test toner images respectively formed under the bias voltages of Vb1 and Vb2.

* * * * *